United States Patent [19]

Magid

[11] Patent Number: 4,621,483

[45] Date of Patent: Nov. 11, 1986

[54] INFLATABLE POUCH AND METHOD OF MANUFACTURE

[75] Inventor: David J. Magid, Doylestown, Pa.

[73] Assignee: Enviro-Spray Systems, Inc., Montgomeryville, Pa.

[21] Appl. No.: 631,068

[22] Filed: Jul. 16, 1984

Related U.S. Application Data

[63] Continuation of Ser. No. 290,256, Aug. 5, 1981, Pat. No. 4,478,044.

[51] Int. Cl.[4] ..... B65B 43/04; B65B 31/10

[52] U.S. Cl. ..... 53/455; 53/470; 53/474

[58] Field of Search ..... 53/450, 445, 455, 474, 53/449, 470; 60/673

[56] References Cited

U.S. PATENT DOCUMENTS

| | | | |
|---|---|---|---|
| 2,347,439 | 4/1944 | Shea et al. | 53/455 X |
| 3,022,613 | 2/1962 | Powers | 53/450 |
| 3,088,256 | 5/1963 | Brown | 53/450 |
| 3,319,539 | 5/1967 | Johnson et al. | 53/455 X |
| 3,593,485 | 7/1971 | Stovall | 53/450 |
| 3,718,236 | 2/1973 | Reyner . | |
| 3,782,067 | 1/1974 | Smolderen | 53/450 |
| 4,360,131 | 11/1982 | Reyner . | |
| 4,373,341 | 2/1983 | Mahaffy et al. | 60/673 |
| 4,376,500 | 3/1983 | Banks et al. . | |

*Primary Examiner*—Horace M. Culver
*Attorney, Agent, or Firm*—Kenyon & Kenyon

[57] ABSTRACT

A fluid-impervious self-inflatable sealed pouch containing separately compartmented first and second gas generating components which, upon admixture in successive discrete quantities, generate gas, causing the pouch to expand gradually from an initial collapsed condition to an ultimately fully expanded condition. Within the pouch is a mechanically rupturable solvent-containing member optimally including a measured quantity of one of said components and the other said component is enclosed by a water-soluble film barrier of polyvinyl alcohol, methylcellulose or the like, additional inner receptacles within the pouch contain measured quantities of said one component for successive release into said admixture caused by expansion of said pouch. A method is provided whereby the pouches are formed in a continuous manner from a plurality of film-like materials fed to respective successive work stations at which receptacles and/or containers are formed, components introduced, permanent and/or releasable seals are formed, water soluble barriers provided and completed pouches delivered in finished form in interconnected and/or severed, independent condition for further utilization.

2 Claims, 17 Drawing Figures

INFLATABLE POUCH AND METHOD OF MANUFACTURE

This application is a continuation of application Ser. No. 290,256 filed Aug. 5, 1981 now U.S. Pat. No. 4,478,044.

FIELD OF THE INVENTION

This invention relates to the field of inflatable pouches for use in dispensing containers and the like to provide pressure as the result of a repeated series of chemical reactions that release gas within the pouch each time a certain volume of the product is dispensed. In particular, the invention relates to an improved pouch that provides better control of start-up of the gas-forming chemical reaction and further provides an improved and simplified method of making such pouches.

BACKGROUND OF THE INVENTION

It is known to dispense liquid products from a dispenser such as an aerosol can, or a garden sprayer apparatus and the like, by internal pressure that forces the product out through a nozzle when a valve is manually actuated. It has been found desirable to generate the pressure by means of a confined chemical reaction that causes gas to be produced within the dispenser without the reactants coming into contact with the product to be dispensed and without release of the reactants to the atmosphere by enclosing the gas-producing chemicals or reactants within a flexible barrier-bag or pouch. Initially, the space occupied by the pouch containing the gas-producing chemicals is only a relatively small part of the total inner volume of the dispenser; the larger part of the dispenser volume is used to hold the product that is to be dispensed. The gas produced by the chemical reaction exerts outward pressure on the flexible bag and thus indirectly on the product to force the product out of the dispenser during use in successive amounts until substantially all of the product is ultimately dispensed.

The quantities of gas-forming materials put into the dispenser initially are determined by the volume of gas that must be produced to expel substantially all of the product with at least a minimum residual pressure for the final quantity to be dispensed, but if the total stoichiometric amounts of these materials are brought together initially so that they can react and produce the gas before any of the product has been dispensed, the initial pressure within the dispenser would be undesirably high. As the product is dispensed under such circumstances, the pressure will gradually decrease and rather than be constant having the pressure too high initially imposes structural requirements on the outer container and involves safety hazards.

In U.S. Pat. No. 3,718,236, the barrier is an inflatable pouch, and it is proposed not to generate all of the gas at once but to generate it in fractional quantities so that only enough pressure will be generated at each stage to inflate the pouch an additional fractional amount, starting with little or no inflation and ending with the pouch virtually filling the dispenser to supplant the product as the product is dispensed. This arrangement makes it possible to generate as much pressure as is needed at any time to dispense the product at a relatively constant rate and keeps the dispensing pressure relatively constant.

Generation of the gas in fractional quantities in the aforesaid patent is accomplished by sealing gas-impermeable walls into the pouch to divide the pouch into a series of chambers. A predetermined portion of at least one of the gas-forming chemical reagents is placed in each chamber as the pouch is being produced, and both reagents and a solvent are placed in the pouch as start-up components for the gas-forming reaction. At least one of the necessary start-up components is separated from the others by encapsulation in a water-soluble coating to prevent the reaction from starting until after the time of sealing the dispenser. Thereafter, as the valve is actuated to open the dispensing orifice, the gas in the pouch expands, expelling some of the product through the orifice. The walls that separate the pouch into chambers can stretch to only a limited extent, and the quantity of at least one of the reagents in the first chamber is limited in amount so that the reaction of that reagent with the other in solution in the pouch will produce only slightly more than enough gas to expand the first chamber fully and to rupture the wall that separates the first and second chambers. This permits admixture of the additional material in the second chamber with the remainder of the solution in the pouch to produce a little more than enough additional gas to expand the combined first and second chambers fully (as enough of the product is dispensed to make that expansion possible) and to rupture the wall separating the second and third chambers. The process is continued, with the formation of successive quantities of gas and expulsion of the product until all of the product has been expelled. The pressure thus generated in the pouch is less than the maximum that would have been generated initially, if the same total quantities of reagents had been mixed all at once, yet the operating pressure provided is still ample.

Typical reagents that have been found to be quite satisfactory are sodium bicarbonate and citric acid which, when mixed in an aqueous solution, produce carbon dioxide. Other reagents can be used instead, such as dilute hydrochloric acid (e.g. 10–30% or even up to about 35%) in place of citric acid, and lithium carbonate or calcium carbonate in place of sodium bicarbonate.

Carbon dioxide is not a dangerous gas in the quantities generated within a typical dispenser, so that even if the dispenser were crushed, the gas forming materials, either before or after the gas-forming reaction, would not be considered toxic or dangerous.

One of the requirements of the structure shown in U.S. Pat. No. 3,718,236 is that the rupturable walls must be attached in a gas-tight manner to the flexible, but stronger, outer walls of the pouch or the barrier that separates the gas-forming reaction from the product to be dispensed. Not only must the rupturable walls be properly attached, but a proper quantity of the selected reagent must be placed within each chamber before the wall to that chamber is sealed. Furthermore, it is desirable to carry out the sealing in such a way that little or no air is trapped within each chamber during manufacture. Any trapped air would displace some of the initial product, and might cause the dispenser to contain less of the desired product than it should contain.

An improved pouch to be inserted in a dispenser is described in U.S. Pat. No. 4,360,131. The pouch disclosed therein does not have individual walls to separate the interior of the pouch into chambers. Instead, an insert containing the small, additional quantities of one of the reagents is placed in the pouch and attached to the flexible walls thereof just before the final assembly of the pouch and of the dispenser. The insert consists of two sheets of plastic smaller in dimension than the pouch. One of the sheets has one or more rows of recesses formed in it. The one reagent is placed in each of these recesses during manufacture of the insert and a second sheet is sealed to the first sheet to keep water, or more particularly, an aqueous solution of the other chemical reagent from reaching the reagent in the recesses. Furthermore, the sealing is arranged at different spaced locations from each of the recesses so that the two sheets can be peeled apart in such a way that the contents of each newly opened recess can admix in sequence with the solution containing the other reagent.

In order to allow the peeling action to take place, one side of the insert is sealed to the inside of the pouch and the other side of the insert is sealed to the opposite inner surface of the pouch. Gas generated within the pouch forces these two opposed parts of the pouch to spread farther and farther apart, to the extent permitted by expulsion of the product being dispensed, thereby peeling the sheets of the insert apart and giving access in a series of steps to the recesses containing the necessary reagent to continue the gas forming reaction. Thus, like the structure in U.S. Pat. No. 3,718,236, the structure in U.S. Pat. No. 4,360,131 allows the chemical reaction to take place in a succession of steps and not all at once, thereby controlling the gas pressure at a relatively constant level.

In using such peelable inserts, it is necessary to place the insert in the pouch, together with the starting solution of an initial quantity of one reagent and a dissolvable or rupturable capsule containing the other reagent, just before the pouch is sealed and just before the dispenser is filled and completed. As a result, it is necessary to provide sealing apparatus at the point of assembly of the dispenser and it is also necessary to be certain that the final manufacturing steps can be carried out in a short time interval before the gas-forming process gets started.

U.S Pat. No. 4,376,500 discloses a further improved version in which one wall of the pouch has recesses formed in it to receive small quantities of one of the reagents. These recesses are sealed, after the reagent had been placed therein, by a small sheet affixed in a manner similar to that described for the insert in U.S. Pat. No. 4,360,131. During expansion of the pouch in use within the dispenser, the small sheet is simply peeled back from the main wall in which the recesses are formed. The starting chemicals, one of them possibly in the form of a powder and capsules containing the other, are placed on one of the pouch outer sheets during assembly, and water is placed in a rupturable container, either as a separate small container to be enclosed within the pouch during manufacture or in a vacuum-formed recess in the same sheet with the other smaller recesses, but to be covered by a rupturable membrane. In either instance, the water is released by rupturing its container, or its cover, just prior to insertion of the pouch in a dispenser. Start-up chemical reaction is delayed until such time as the water has dissolved the powdered, loose reagent and the capsule containing the other reagent to allow the reagents to react and generate gas. From that point on, the peeling back of the small sheet to expose successive quantities of the reagent in the small recesses proceeds as in U.S. Pat. No. 4,360,131.

In the manufacture of any of the foregoing structures, the handling of the reagents must be carefully controlled. Using them in capsule form adds to the costs because of the expense of the capsules. Different start-up pressures are required to dispense different products from different dispensers, and this requires the availability of a large inventory of combinations of capsules of different size or different content of one of the reagents. In addition, using one of the chemicals in powder form during the assembly of the pouch structure may cause excessive dust in the assembly plant. Furthermore, it is desirable to be able to control, fairly accurately, the length of time between initiation of the start-up reaction and the time the reaction itself begins to cause gas to be formed.

BRIEF SUMMARY OF THE INVENTION

In accordance with this invention, starting recesses are formed in a plastic sheet base member to receive materials for initiating a gas-forming chemical reaction. The starting material in a first one of the starting recesses is water or an aqueous solution of one of the chemical reagents, and this recess is covered by a small sheet of material that is impervious to the liquid in the recess but ruptures in response to mechanical pressure. A second starting recess holds either a dry mixture of both of the reagents used to start the reaction or a quantity of the second reagent in dry form, depending on whether the first starting recess contains water or a solution of the first reagent. In the latter event, the second recess contains sufficient of the second reagent to carry the gas forming reaction to completion. The second recess is covered by a small sheet of material soluble within a predetermined time in the liquid in the first recess. Soluble polyvinyl alcohol (PVA) film is particularly suitable for this purpose. As a further alternative, a small soluble bag of PVA or other soluble material containing the dry reagent can be used instead.

Additional recesses formed in the base member hold additional reagent material in solution or in dry form. These recesses are covered by a sheet of material impermeable to solutions that reach it from the starting reaction. This sheet is releasably sealed to the base material in such a way that it can be peeled away to open each of the additional recesses in sequence. As the sheet is peeled away, the additional reagent material in each of the additional recesses, in turn, is added to the existing solution to produce more gas within the pouch and thus to provide continued force to inflate the pouch further.

The pouch is formed around the base member by directing the latter between two sheets of pouch material and forming a perimeter seal that surrounds the base member. In addition, one portion edge of the sheet that covers the additional recesses is non-releasably sealed to one of the pouch sheets while another non-release seal is formed between the second pouch sheet and an area of the surface of the base member facing the second pouch sheet. These two last-mentioned seals are located so that, as the pouch inflates, the areas of the pouch sheets on which these two seals are formed will spread apart, thereby peeling the cover sheet away from the additional recesses.

In the method of manufacture, a base member of plastic film material capable of being heated and vacuum formed is directed through a series of stations to create such recesses. Appropriate chemical reagents are then placed in the recesses, after which the recesses are closed by cover sheets of suitable plastic material sealed liquid-tight to the base member.

The various cover sheets are then sealed to the base member containing the filled recesses, and such assembly is then severed to separate the base member into two separate assemblies, one comprised of said additional reagent containing recesses and the other comprised of said first and second starting recesses. These individual members are fed as inserts between upper and lower plastic pouch sheets, and a non-release seal is formed in the proper region of the first mentioned separate assembly to cause the cover sheet over said additional reagent recesses to be securely attached to the upper pouch sheet and to cause the underside of the base member directly aligned therewith to be securely attached to the lower pouch sheet. Following the seal required to achieve such peeling operation, a perimeter seal is produced that forms a water-tight and gas-tight perimeter for the entire pouch. The pouches may be separated from each other at that stage or they may be rolled up as finished units to be shipped and later unrolled and separated just before each is placed in a separate dispensing container.

It is one of the objects of this invention to provide an inflatable pouch which can be completed and then stored indefinitely and which will begin to inflate at a predetermined time after component parts inside the pouch have been manipulated or otherwise activated to initiate a gas-forming chemical reaction.

Another object is to provide an improved method of manufacture of such a pouch.

Still another object is to provide a pouch in which the chemical reagents are separated by a barrier that dissolves in water or other solvent in a controlled length of time.

A further object is to provide an improved pouch in which one or both gas forming chemical reagents are in the form of beads or particles with soluble coatings.

Still a further object of this invention is to provide a simplified method of assembly of an improved pouch structure by a simple procedure consistent with production of the pouches in quantity.

Still further objects may become apparent to those skilled in the art after reading the following specification and the drawings.

DETAILED DESCRIPTION

Figure 1:
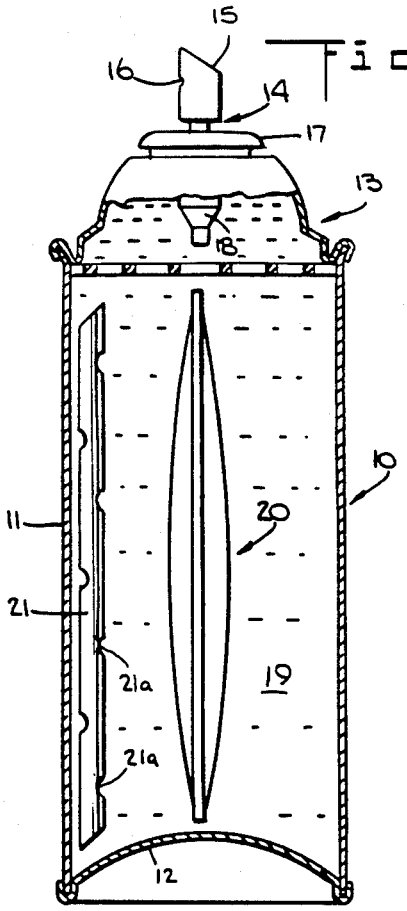
FIG. 1 is a cross-sectional view of a dispenser containing a pouch made according to the present invention.

FIG. 1 shows a conventional dispensing container 10 of the aerosol type that has a cylindrical body 11, an inwardly dished bottom 12, and a bell-shaped top 13. The components just described can be fabricating from any suitable material, such as thin guage aluminum or other metal, or even plastic, depending on the product to be dispensed and on any governing safety specifications that might be involved. A valve assembly 14 of conventional design is mounted in the bell-shaped top 13. The valve assembly includes a plunger and spray head, or nozzle 15 that carries a spray orifice 16. A mounting cup 17 attaches the valve assembly 14 to the bell-shaped top 13, and an intake member 18 extends downwardly within the interior of the bell-shaped top. Within the container 10 is a liquid product 19 and a pouch 20 within which pressure is generated to inflate the pouch to expel the product 19 when the nozzle 15 is actuated.

When a substantial portion of the product 19 has been dispensed through the nozzle, the pouch 20 will have inflated so that it almost completely fills the cylindrical interior of the dispenser 10. When that occurs, it is possible for the intermediate portion of the pouch to press against the interior wall of the cylindrical body 11, trapping some of the product 19 in the lower part of the dispenser adjacent the dished bottom 12. In order to prevent that, a hollow tube 21, optionally with several openings 21*a* spaced along its length is supported longitudinally along the inner surface of the cylindrical body 11 by any conventional means (not shown). Any entrapped portion of the product 19 adjacent the bottom of the dispenser 10 can be forced upwardly through the tube 21 by the normal inflationary pressure of the pouch 20.

Figure 2:
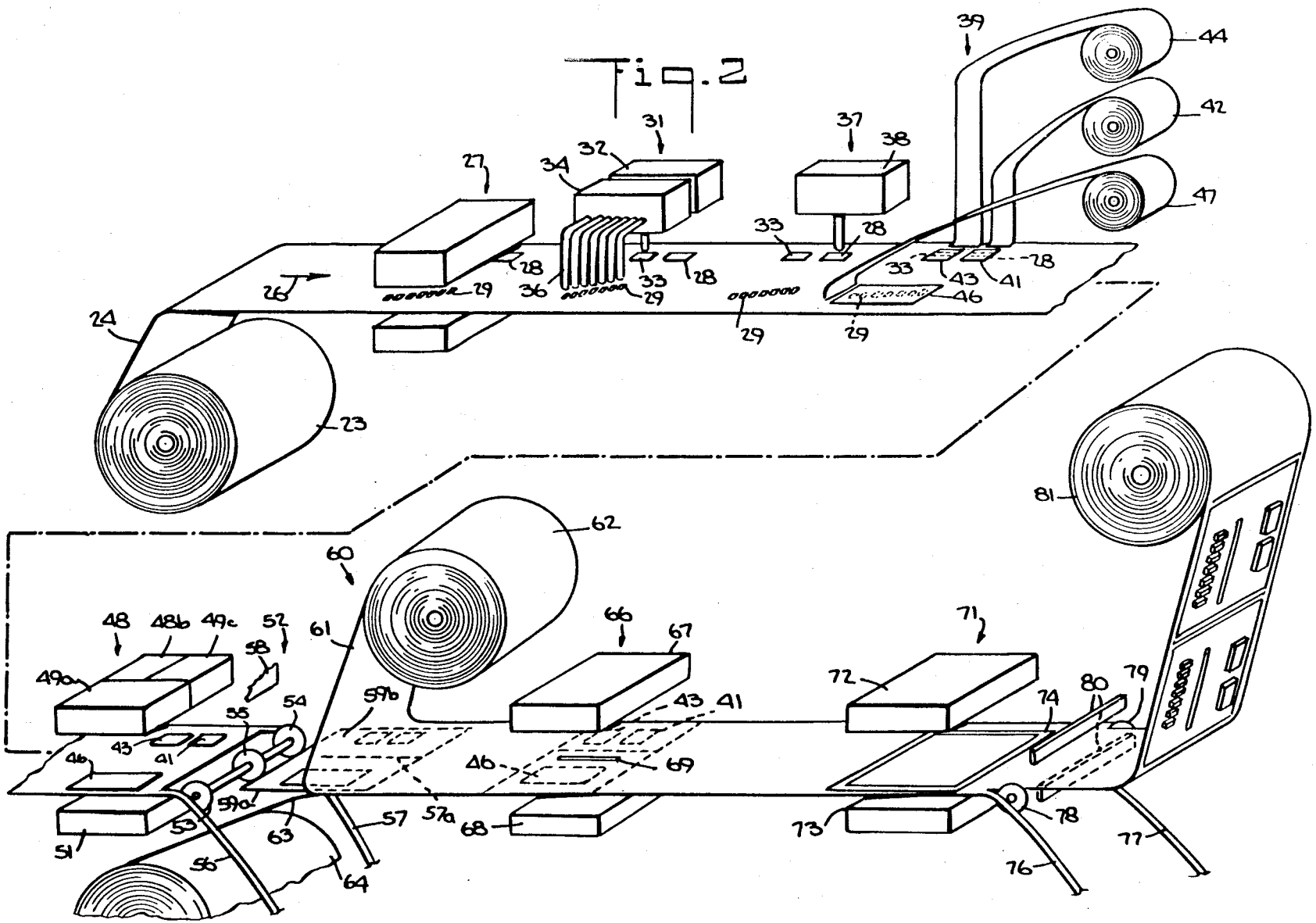
FIG. 2 is a simplified schematic diagram illustrating the manufacture of the pouch shown in FIG. 1.

FIG. 2 illustrates the manner in which pouch 20 of FIG. 1 is assembled. The assembly begins with a roll 23 of a suitable plastic material consisting of one or more plies. Polyethylene and polypropylene have the desired strength and flexibility and sheets of such materials can be vacuum-formed and heat-sealed, but because of their slight porosity should be laminated with a vapor barrier layer. For example, a sheet of two layers of low-density polyethylene or polypropylene with an intermediate vapor barrier of another plastic material, such as saran, or of aluminum foil can be used. The low-density polyethylene may vary from about 0.5 to about 20 mils in thickness and the polypropylene from about 0.1 to about 3.75 mils or more. If the vapor barrier is metal foil, it is desirable that it be placed between the plastic layers to prevent it from reacting with either the product to be dispensed or the gas-forming reagents.

Releasable seals are normally effected between non-homogeneous or relatively incompatible materials, such as polyethylene to polypropylene. Permanent or non-releasable seals are effected between homogeneous or relatively compatible materials, such as polyethylene to polyethylene or polypropylene to polypropylene, which technique is well-known in the art. Such seals are normally made by applying sufficient heat to the areas to be joined together, but other permanent and releasable sealing methods can be carried out by using appropriate separate conventional and well-known adhesive compositions, if desired.

Plastic material 24 from roll 23 will be referred to herein as the base material or member because other components of the pouch are deposited on or formed in it. Base member 24 is moved generally horizontally in the direction of the arrow 26 by standard conveying means (not shown) and passes first through a station 27 in which the base material is heated and vacuum formed to produce several recesses, including two relatively large side by side recesses 28, 33 and a diagonal row of smaller recesses 29 (see also FIG. 4). The latter row is at an angle to the longitudinal direction of the base material 24 for a reason to be described later.

After leaving the station 27, the base material 24 is delivered to a second station 31 that includes dispensing apparatus 32 to dispense either water or an aqueous solution of one of the gas-forming reagents into recess 33. The station 31 also includes dispensing means 34 that in the embodiment shown has the same number of outlets 36 as the number of recesses 29. The purpose of the dispensing means 34 is to dispense one of the gas-forming chemical reagents, preferably in the form of an aqueous solution, into each of the recesses 29. This may be the same reagent dispensed into the recess 33, but it is not necessarily the same nor is it necessarily at the same concentration. In fact, the amounts or concentrations dispensed into the recesses 29 need not all be identical but can be chosen to generate the proper amount of gas at each stage, when the structure is finally, put into use in a dispenser.

After leaving the station 31, base material 24 is delivered to the next station 37 where dispensing means 38 dispenses into recess 28 the second chemical reagent, in dry form. The reagent placed in recess 28 may be only one of the gas-forming materials or it could be a mixture of both of the gas-forming reagents, i.e., the total stoichiometric amount of one of said reagents and a partial start-up quantity of the other reagent, the balance of the latter reagent being contained in recesses 29. Packaging both ingredients together in recess 28 as described has the advantage that when water or the aqueous solution from the recess 33 contacts both reagents in recess 28, a faster start-up reaction is provided.

From station 37, base material 24 passes to a station 39 at which covering films are placed over recesses 28, 29 and 33. The cover 41 placed over the recess 28 is severed from roll 42 of water-soluble plastic film or the like. In particular, it has been found that a partly hydrolyzed polyvinyl alcohol having a thickness of about 1.0 to 4.0 mils, preferably 2.0 mils, is especially suitable as the material for cover 41 because it is cold water soluble. However, other types of PVA film which are hot water soluble can also be used, e.g., for activation as assembled dispenser can 10 is passed through a hot water bath to heat up the can. Such material is fed from roll 42 to the proper region to cover the recess 28, and a piece of the roll is cut off to provide cover 41. Cover 43 to enclose recess 33 is cut from film supplied by another roll 44, and a sheet 46 to cover recesses 29 is cut from film supplied by third roll 47. The films of rolls 44 and 47 are water impervious and water resistant.

Base material 24, with covers or lids 41, 43 and 46 on it passes to the next station 48 at which respective heat sealing devices 49*a*, *b* and *c* and corresponding lower members 51 (one shown) seal the perimeters of covers 41, 43 and 46 to base material 24 around the perimeters of the recesses 28, 33 and 29, respectively. Sheets 24 and 46 are appropriately laminated to be releasably sealed to one another and permanently sealed to pouch walls 61 and 63. As in either of the aforementioned U.S. patent application Ser. Nos. 105,216 and 172,357, the locations of the sealed portions of cover 46 to base member 24 are spaced outwardly from recesses 29 so that when the structure being manufactured is later put into use and cover 46 is peeled away from the base material 24, the recesses 29 will be exposed one at a time.

As is well-known to those skilled in the art, the time, pressure and temperature involved in this heat sealing operation depend on the particular plastic films being used and the physical integrity of the seal required for liquid and gas impermeability and the optimum characteristics required for the desired shelf life of the finished pouch assembly.

Base member 24 with the enclosed reagents may be stored on a reel for later incorporation in a pouch, or may be slit into individual inserts immediately after leaving the sealing station 48.

In the latter case, the sheet of base material 24 passes through a cutting station 52 where rotary circular blades 53, 54 and 55 slit the edge portions 56, 57 and center line 57*a* of the sheet of material 24. Knife 58, only a fragmentary portion of which is shown, separates each incremental section of the sheet 24 transversely from the remainder of the sheet and allows the severed portions 59*a*, 59*b* to be passed along to next station 60.

At station 60, separated inserts 59*a* and 59*b* are fed between an upper sheet 61 of pouch wall material from a roll 62 and a lower sheet 63 of pouch wall material from a roll 64. At station 66, heat sealing devices 67 and 68 form a longitudinal separation seal 69 between insert 59*a* and upper sheet 61.

Seal 69 is effected by a proper correlation of time, temperature and pressure, depending on the particular film being used and such correlation can readily be determined by those skilled in the art. In general, the temperature used will usually be within about $\pm 10°$ F. of the temperature of the other heat sealing effected at station 48 for the inserts 59*a* and 59*b*. Seal 69 determines the pressure of release of cover 46 from recesses 29.

The final station in the pouch assembly apparatus is station 71 at which heated presses 72 and 73 heat-seal the sheets 62 and 63 sufficiently to form a perimeter seal 74 that outlines a pouch. Although the pouch shown in station 71 appears to be separated quite widely from the assembly of components in station 66, in actual operation as formed the pouches will be immediately adjacent each other.

After being sealed in station 71, the edges 76 and 77 of the sheets 62 and 63 may be cut off by rotary circular slitting wheels 78 and 79 and the pouches may then either be slit apart transversely by cutting means 80 to be handled individually or they may be kept in attached form so as to be rolled up on a roll 81 as shown.

Figure 3:
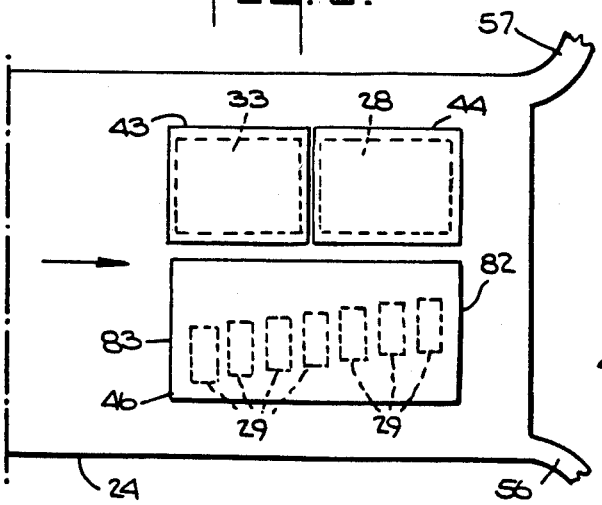
FIGS. 3 and 3A illustrate the pouch slitting step in the method of manufacture depicted in FIG. 2.
Figure 3A:
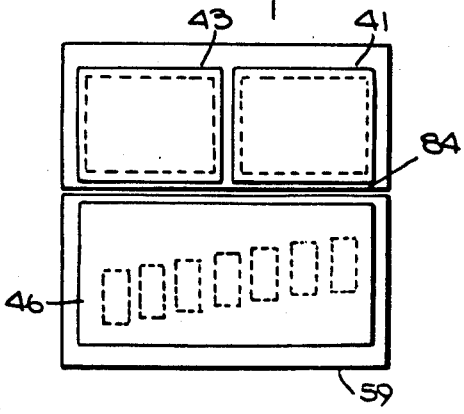

FIGS. 3 and 3*a* show the arrangement of base material or carrier member 24 as it leaves station 48 and enters the slitting operation at station 52. Sheets or covers 41, 43 and 46 are sealed entirely around the perimeters of respective recesses 28, 33 and 29. Preferably, the entire portion of each of these covers that overlap sheet 24 is sealed thereto. In the case of cover 43, it is imperative that it retain the liquid in recess 33 until the proper time for that liquid to be released. Otherwise, the liquid might reach cover 41 and begin to dissolve it prematurely.

In the case of cover 46, it is desirable that recesses 29 be exposed one at a time during use. Thus it is desirable that cover 46 be peeled away from base member 24 starting at one end of the line of recesses 29 and proceeding toward the other or starting at end edge 82 and proceeding toward the opposite edge 83. By providing a sufficiently large area of adherence of cover 46 to base member 24, the desired subsequent peeling operation can be accomplished smoothly.

FIG. 3*a* shows inserts 59*a* and 59*b* as severed from the remainder of base material 24. Central slit 84 is cut all the way through the assembly by rotary cutter 55 at station 52 (FIG. 2) to separate it into independent members 59*a* and 59*b*. This separation is required to facilitate peeling sheet 46 away from the remainder of the insert when the insert is later put into use in the pouch.

Figure 4:
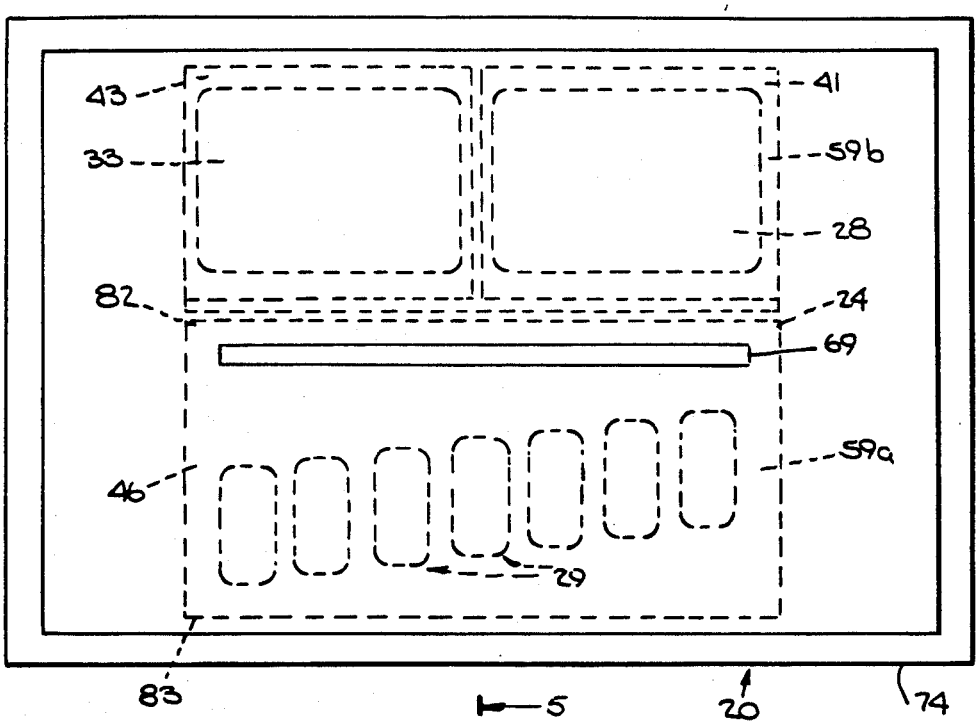
FIG. 4 is an enlarged plan view of an assembled pouch.

FIG. 4 shows inserts 59*a* and 59*b* sealed into pouch 20. The overall size of the pouch 20, as defined by the perimeter seal 74 is determined by the size of the dispenser in which it will be placed. However, inserts 59*a* and 59*b* may be approximately of the same overall size for a variety of different sizes of pouches. Although larger pouches may require that more gas be produced, this can be accomplished by changing the concentration of the reagents, or by a mold change to produce a larger cavity, particularly in the recesses 29, although it is also necessary that there be sufficient reagent in one of the starting recesses 28 and 33 to form a chemical equivalent with the other reagent, whether that reagent be in the other starting recess or the same starting recess and in the additional recesses 29. In any case, it is desired that the final admixture of all of the reagents whe pouch 20 has been substantially fully inflated, provide sufficient pressure within the dispenser 10 (FIG. 1) to expel the final portion of product 19 with adequate dispensing force. The concentration of the reagent in recesses 29 can be calculated back from that point so that, as the reagent in each of the recesses is made available in turn to be mixed with the remainder of the other reagent available from previous admixing, the amount of gas generated will be sufficient to continue the expansion of the pouch, as the product is expelled, far enough to open up the next recess 29 or to complete the expulsion of the product if the inflation of the pouch has reached the final stage.

FIG. 4 shows the location of the separation seal 69 that is established in station 66. This seal is adjacent recesses 29 an along the edge portion 82 of sheet 46, and it is by this seal that the sheet 46 is permanently joined to the sheet or top wall 61 of pouch 20. Correspondingly, and directly beneath seal 69 is a similar seal between the portion of base material 24 and lower sheet 63 of the pouch 20. These aligned seals, though separate, are referred to collectively as the separation seal. The purpose of separation seal 69 is to provide control over the opening of recesses 29 so that it occurs in sequence one at a time rather than two or more recesses 29 opening simultaneously during expansion of the pouch in use and to permanently attach the insert 59*a* to pouch 20 to cause opening of cavities 29 as pouch 20 expands.

Figure 5:
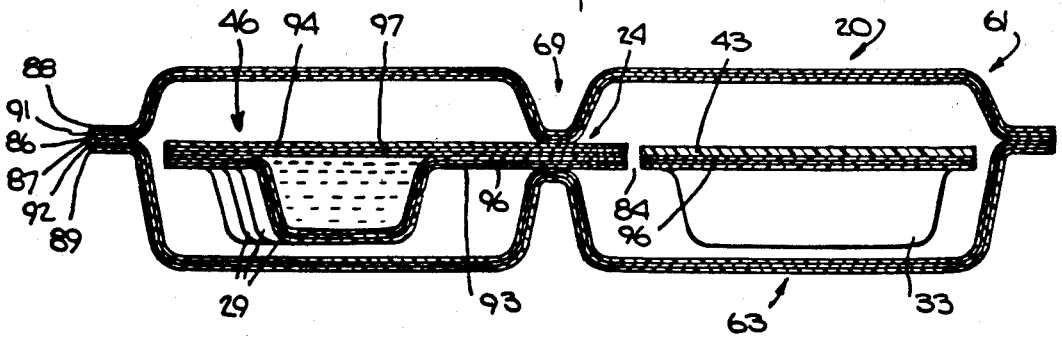
FIG. 5 is a cross-sectional view taken along lines 5—5 of FIG. 4.
Figure 8:
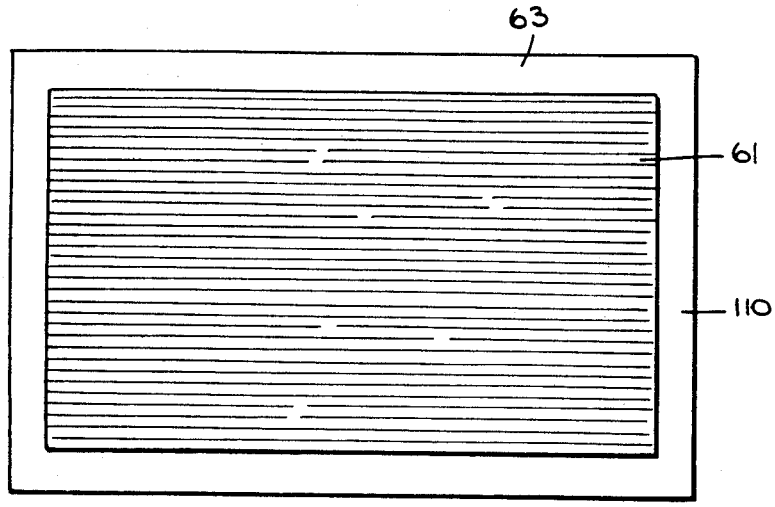
FIGS. 8–11 are schematic diagrams of a method of folding and sealing the edges of the top and bottom outer walls of the pouch of the present invention.
Figure 9:
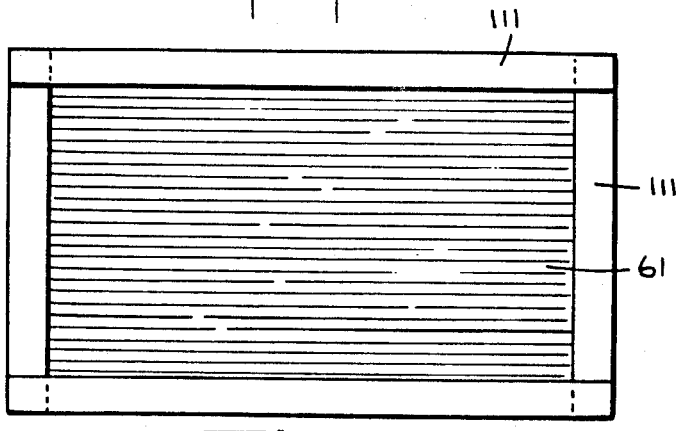

In FIG. 5 the thicknesses of the sheets of material in the pouch 20 are greatly exaggerated to make their component layers visible. Outer pouch walls 61 and 63 must be firmly bonded together to make the pouch absolutely gas-tight. As a result, lower layer 86 of the wall 61 and the upper layer 87 of wall 63 juxtaposed therewith are of compatible material capable of forming a permanent seal. For example, both layers 86 and 87 can be of polyethylene or both of polypropylene. Outer layers 88 and 89 are not required to be sealed to anything and therefore need not be compatible. They provide protection for respective central barrier layers 91 and 92 and increase the strength of the pouch walls.

Lower layer 93 of base material 24 that has become a carrier member for the chemical materials in the various recesses, of which only recess 33 and some of the recesses 29 are shown in FIG. 5, must bond strongly to the layer 87 by separation seal 69. The other part of the separation seal is between the top layer 94 of the sheet 46 and the bottom layer 86 of the pouch wall 61. The bond between the layers 86 and 94 must also be strong, and it is appropriate for all of layers 86, 87, 93 and 94 to be of the same material, such as all polyethylene or all polypropylene to form permanent seals where the bonding must be strong.

It is equally important that the bond between upper layer 96 of material 24 and lower, juxtaposed layer 97 of sheet 46 be releasable when pouch 20 inflates. Thus, it is desirable for the layers 96 and 97 to be relatively incompatible, such as, for example, one of polyethylene and the other of polypropylene, or some chemical additive may be employed to form a peelable seal therebetween.

Sheet 43 must be rupturable but, until it is ruptured, it must be impermeable to liquid in the recess 33. Thus a single layer of non-porous material that can be bonded liquid-tight and permanently to layer 96 is sufficient. It must be insoluble in the liquid solvent in recess 33.

The quantities and concentrations of reagents in recesses 28, 29 and 33 vary according to the start-up pressure required and the final pressure and volume when pouch 20 is fully inflated. Typically, it is desired that the maximum pressure generated in the container 11 in FIG. 1 be not more than about 140 psig ±20% at an ambient temperature of about 20° C. for a container 11 capable of withstanding an internal pressure of about 180 psig. For a specific example, the material placed in recess 33 may be a 20% solution of citric acid in water, and the material placed in recesses 29 at the same time may be a 50% solution of citric acid in water. The material placed in recess 28 may be beaded sodium bicarbonate in an amount sufficient to be a chemical equivalent of all of the citric acid.

Figure 6:
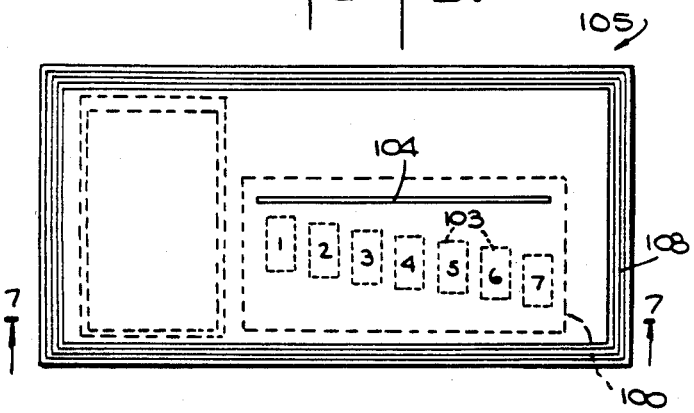
FIG. 6 is an enlarged plan view of another configuration of an assembled pouch.
Figure 7:
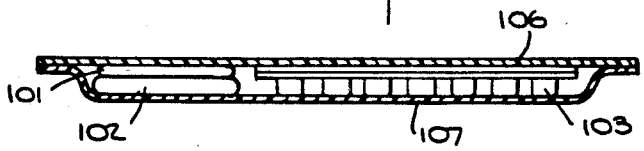
FIG. 7 is a longitudinal section taken along lines 7—7 of FIG. 6.

FIGS. 6 and 7 show an alternate embodiment of insert 100, PVA packet 101 and burstable bag 102, corresponding to inserts 59*a* and 59*b* of FIG. 4. In FIGS. 6 and 7 insert 100 carries diagonal reagent containing recesses 103 similar to recesses 29 of the FIG. 4 embodiment. Separation seal 104 corresponds to seal 69 of FIG. 4. Instead of solvent and start-up recesses 33, 28 as shown in FIG. 4, the FIG. 6 and 7 embodiment has separate water soluble PVA bag, or packet 101 containing reagent material and additional separate bag 102 containing the solvent with or without the other reagent material. Bags 101 and 102 may be disposed in pouch 105 in superimposed relation as shown in FIG. 7. Pouch 105 has top and bottom sheets 106, 107 respectively which are heat sealed at their contacting peripheries 108 as in the previously described embodiment.

In another alternative to the vacuum formed recess 28 (FIG. 2) and PVA packet 101 (FIG. 7), the one reagent such as sodium bicarbonate may be spray coated or otherwise encased in a layer of water soluble PVA in finely divided or compacted form such as small beads and disposed in the interior of the pouch for contact by the solvent in the same time sequence as with the other two embodiments.

Figure 10:
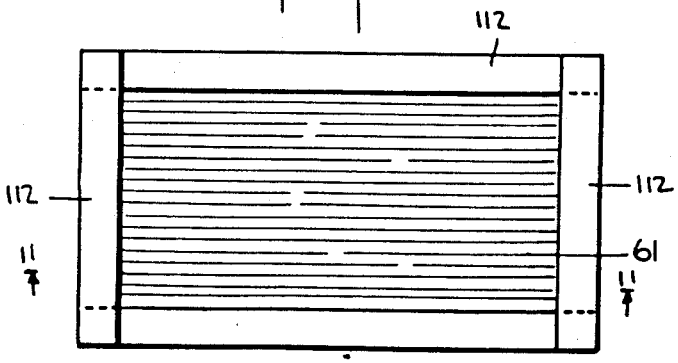
Figure 11:
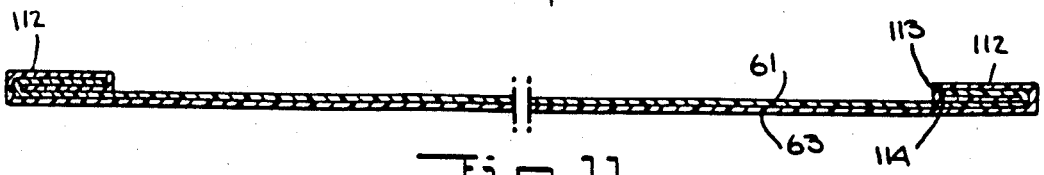

FIGS. 8–11 depict an alternate method of sealing pouch 20 by dimensioning bottom sheet 63 larger than top sheet 61 to provide a foldover marginal extension 110 on bottom sheet 63 (FIG. 8) that is first folded inwardly to overlap the periphery of top sheet 61 (FIG. 9), then that peripheral fold 111 is again folded inwardly to provide in effect a double inward fold 112 as shown in FIGS. 10, 11 (which is then heat sealed in the above described manner) in which the cut edges 113, 114 of sheets 61, 63 are sealed inwardly and out of contact with the solvent. Such construction prevents delamination of the multi-layered plastic films employed by the action of the solvent on the cut edges of the sheets such as 61 and 63 where the laminations were otherwise exposed to various chemical products.

Figure 13:
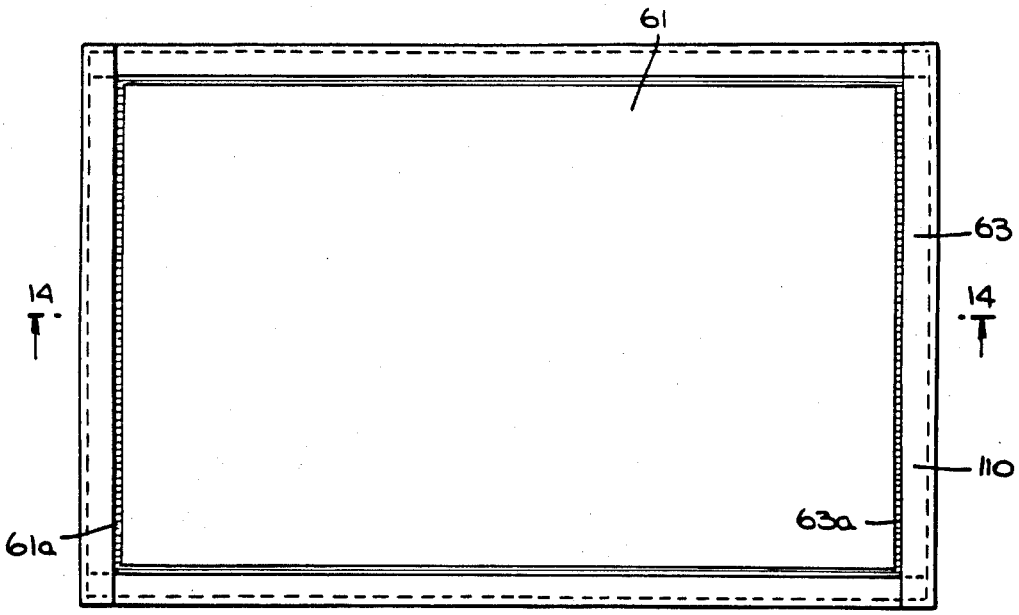
FIGS. 13 and 14 depict an alternate peripheral sealing arrangement for the marginal edges of the pouch top and bottom walls.
Figure 14:
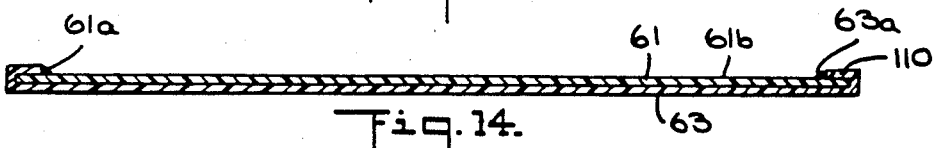

Another sealing arrangement of top and bottom outer walls 61, 63 of pouch 20 is shown in FIGS. 13 and 14. The marginal extension 110 on bottom wall 63 is folded over top wall 61 as shown and at the junction of inner marginal edge **63*a* of bottom wall 63 and top wall 61 is applied a suitable sealing substance 61*a* that is compatible with the exposed surfaces 61*b*, 63*b* of top and bottom walls 61, 63** respectively, such as polyethylene, polypropylene, urethane or epoxy, as the case may be, by spraying or other suitable conventional method of application of said substance.

Figure 15:
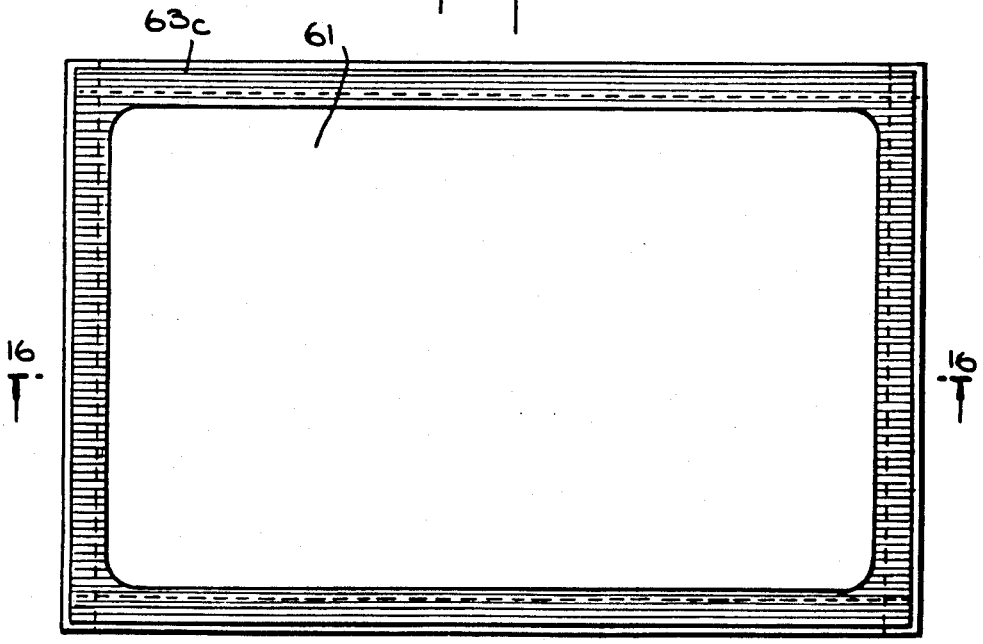
FIGS. 15 and 16 depict still another sealing arrangement of the pouch top and bottom walls including a sealing gasket.
Figure 16:
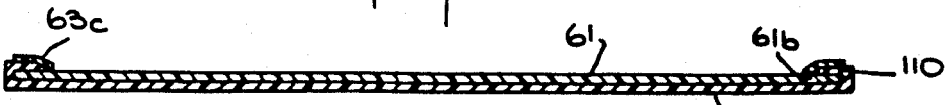

A further sealing arrangement is shown in FIGS. 15 and 16 wherein suitably dimensioned gasket material **63*c* of generally rectangular form is overlayed on folded extension 110 of bottom wall 63 and the adjacent exposed portion 61*b* of top wall 61. Gasket 63*c* is of the same material as the exposed film material of top and bottom walls 61, 63**, or is compatible therewith and is heat sealed or otherwise adhered in place to said walls.

Figure 12:
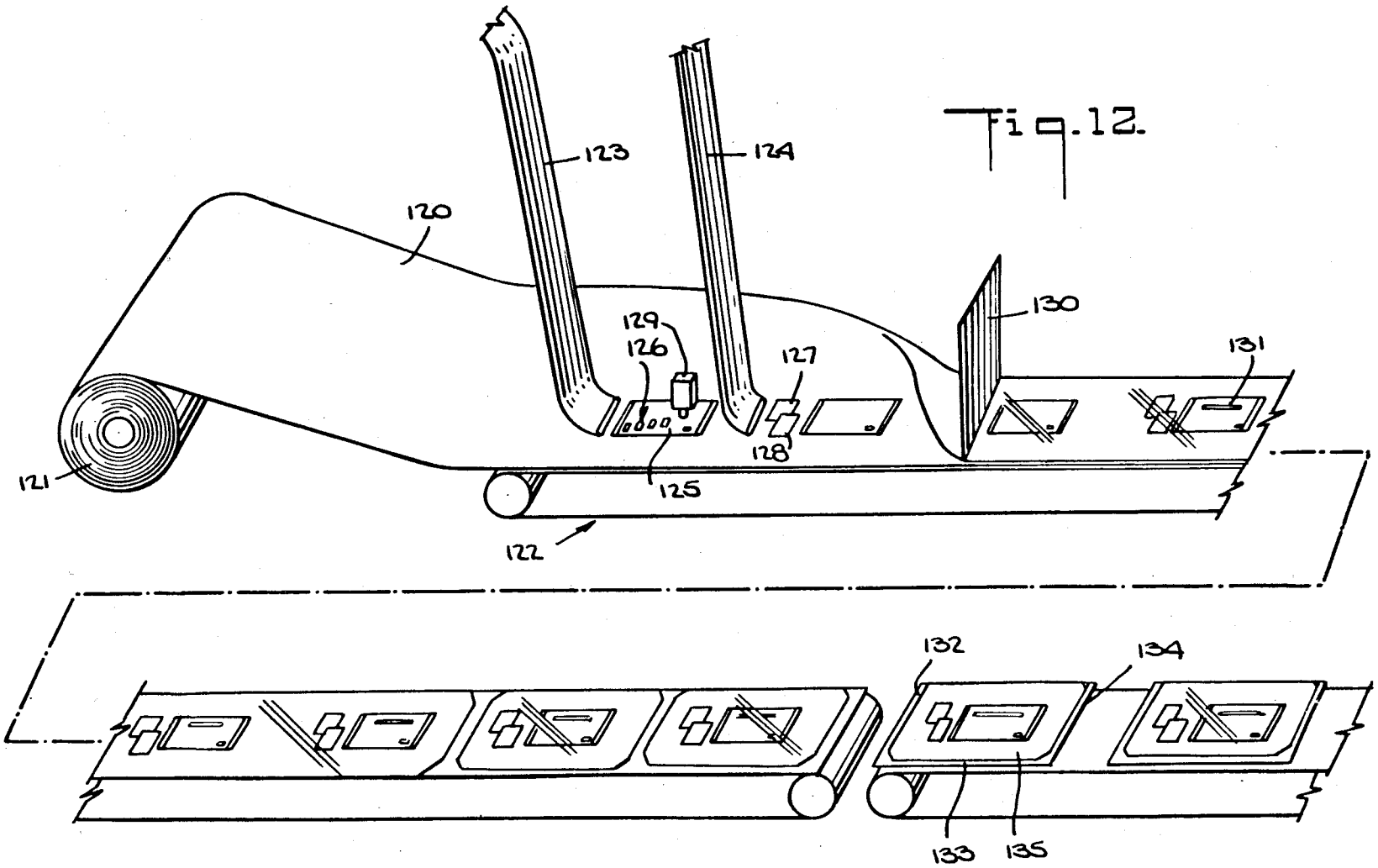
FIG. 12 is a schematic diagram of an alternate assembly method for forming the pouch.

Another assembly method for the pouch is shown in FIG. 12 and utilizes web 120 fed from supply roll 121 to a conveyor belt 122 which conveys the web through a plurality of assembly stations as shown. At an initial station feed shutes 123, 124 deliver insert 125 containing the plurality of staggered recesses 126 (similar to FIGS. 3 and 6), and water packet 127 and water soluble PVA packet 128 respectively to one side of the longitudinal center line of web 120. Insert 125 is tacked or heat sealed to web 120 by any conventional tacking device 129 to hold it in place.

Web 120 is then folded over along its center line by a mandrel or other device 130 to cover insert 126 and packets 127, 128. Separation weld 131 is applied and the three open edges 132, 133, 134 are then heat sealed and severed transversely to separate the pouch assembly 135 which is then delivered to a can assembly station or storage.

Alternatively the web may, at or just prior to the initial station, be folded along its longitudinal center line by a mandrel or other device (not shown) to provide a flat portion for receiving insert 125 and packets 127, 128, and a generally upright or vertical portion which remains in said upright position until folded down by mandrel 130. Such arrangement permits a more compact assembly line lateral dimension.

The above description exemplifies the novel and nonobvious contribution to the art by the present invention. A simpler and more efficient method of manufacture and pressure start-up has been provided, minimizing the necessity of formulating start-up reagent materials for different operating pressures, reducing dust hazards in assembly plants, providing greater reliability of operation of the pressure generating package and greater and more reliable shelf life. Many other advantages in here in the features described above.

While certain embodiments of the invention have been shown and described herein, it is to be understood by those skilled in the art that modifications may be made therein without departing from the scope and spirit of the invention.

What is claimed is:

1. A method of assembling a self-inflating plastic pouch comprising the steps of:

(1) delivering a longitudinal web of plastic sheet material to a first station, (2) folding said web along its longitudinal center line to provide a substantially vertical portion and a flat portion, (3) placing a first packet containing a plurality of staggered recesses containing a first gas generating component on said flat portion and heat sealing it to said flat portion, (4) placing a burstable water packet and a water soluble PVA packet containing a second gas generating component on said flat portion adjacent said first packet, (5) folding said vertical portion over said flat portion to enclose all said packets, (6) sealing said first packet permanently to said folded over portion along a line extending longitudinally of said first packet adjacent one side portion thereof, (7) sealing said web portions together to form a sealed envelope containing said packets, and (8) severing said envelope from said web.

2. A method of assembling a self-inflating plastic sheet pouch comprising the steps of:

(1) delivering a longitudinal web of plastic sheet material to a first station, (2) placing a first packet containing a plurality of staggered recesses containing a first gas generating component on said web at one side of the longitudinal center line thereof and heat sealing said first packet to said web, (3) placing a burstable water packet and a water soluble PVA packet containing a second gas generating component on said web adjacent said first packet, (4) folding said web along its center line over the web portion containing said packets to enclose all said packets, (5) sealing said first packet permanently to the folded over portion along a line extending longitudinally of said packet adjacent one side portion thereof, (6) sealing the web portions together to form a sealed envelope containing said packets, and (7 ) severing said envelope from said web.

* * * * *